US011821184B2

(12) United States Patent
Tracy

(10) Patent No.: US 11,821,184 B2
(45) Date of Patent: Nov. 21, 2023

(54) SOFT-CLOSE SPRAY HEAD FAUCET

(71) Applicant: ASSA ABLOY Americas Residential Inc., New Haven, CT (US)

(72) Inventor: Adam William Tracy, Irvine, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 155 days.

(21) Appl. No.: 17/337,549

(22) Filed: Jun. 3, 2021

(65) Prior Publication Data

US 2021/0381210 A1 Dec. 9, 2021

Related U.S. Application Data

(60) Provisional application No. 63/034,131, filed on Jun. 3, 2020.

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 1/0404; E03C 2001/0415
USPC ..... 4/567, 678, 675
See application file for complete search history.

(56) References Cited

U.S. PATENT DOCUMENTS

| | | | | |
|---|---|---|---|---|
| 9,284,723 | B2 * | 3/2016 | Esche | E03C 1/0404 |
| 2004/0135010 | A1 * | 7/2004 | Malek | E03C 1/0404 239/530 |
| 2006/0283511 | A1 * | 12/2006 | Nelson | E03C 1/0404 137/801 |
| 2013/0327853 | A1 * | 12/2013 | Keiter | E03C 1/0404 239/587.1 |
| 2014/0166124 | A1 * | 6/2014 | Davidson | E03C 1/0404 137/315.01 |
| 2017/0314241 | A1 * | 11/2017 | Myers | E03C 1/0404 |
| 2019/0071849 | A1 * | 3/2019 | Myers | E03C 1/0404 |
| 2020/0063407 | A1 * | 2/2020 | Zhu | E03C 1/0404 |
| 2020/0063408 | A1 * | 2/2020 | Tracy | E03C 1/0404 |
| 2020/0141097 | A1 * | 5/2020 | Tracy | E03C 1/0404 |
| 2020/0240126 | A1 * | 7/2020 | Myers | E03C 1/0404 |
| 2021/0388583 | A1 * | 12/2021 | Peng | E03C 1/0404 |
| 2021/0404156 | A1 * | 12/2021 | Tracy | E03C 1/0404 |

FOREIGN PATENT DOCUMENTS

| | | | | |
|---|---|---|---|---|
| CA | 3158678 | A1 * | 11/2022 | E03C 1/0403 |
| CN | 115247446 | A * | 10/2022 | E03C 1/0404 |
| EP | 2690228 | A2 * | 1/2014 | B05B 1/185 |
| EP | 3438357 | A1 * | 2/2019 | B05B 15/65 |

(Continued)

*Primary Examiner* — Lori L Baker
(74) *Attorney, Agent, or Firm* — Merchant & Gould P.C.

(57) ABSTRACT

A soft-close pull-out faucet is disclosed. In one aspect, a faucet includes a faucet base, a faucet spout, and a spray head movable between a retracted position and an extended position. A hose extends through the faucet spout and connects to a water source and a spray head. A magnet is connected to the hose. A ring collar is fixed at least partially within the faucet spout and is formed of a non-ferretic and non-magnetic conductive material. The hose and the magnet are movable relative to the ring collar, and the magnet is positioned at least partially within the ring collar when the spray head is located in the retracted position.

22 Claims, 6 Drawing Sheets

(56) References Cited

FOREIGN PATENT DOCUMENTS

| | | | | | |
|---|---|---|---|---|---|
| WO | WO-2005110549 | A1 * | 11/2005 | ..... | E03C 1/0404 |
| WO | WO-2014130816 | A1 * | 8/2014 | ..... | E03C 1/04 |
| WO | WO-2021138701 | A1 * | 7/2021 | ..... | E03C 1/0404 |
| WO | WO-2022226854 | A1 * | 11/2022 | ..... | E03C 1/0404 |

* cited by examiner

SOFT-CLOSE SPRAY HEAD FAUCET

CROSS-REFERENCE TO RELATED APPLICATION

This application claims the benefit of U.S. Provisional Application Ser. No. 63/034,131, filed Jun. 3, 2020, the disclosure of which is hereby incorporated by reference in its entirety.

TECHNICAL FIELD

This invention relates to the field of faucets. In particular, this invention relates to a device and method for a soft-close retractable faucet.

BACKGROUND

Many faucets, such as kitchen faucets, include a retractable spray hose with a spray nozzle. The pull-out head allows the user to point water flow from the pull-out head to destinations where the flow is useful and where conventional faucets may not reach. For example, when washing pots and pans, the user may pull out the head and direct the flow into the pots and pans rather than moving the pots and pans under the faucet. Because the pull-out head is typically much lighter and much easier to negotiate than the item that is being washed, this adds to user convenience.

Presently, kitchen spray heads on pull-down faucets retract when a user releases the spray head. This may be accomplished, conventionally, using a weight that is positioned on a hose that is connected to the spray head, and which is located below a countertop and/or sink. When released by a user, the spray head retracts back toward the spout tube as the hose is pulled back through the spout tube by the weight. The spray head stops moving when the spray head has reached the spout tube.

This arrangement is convenient, but has some disadvantages. For example, the impact of the spray head on the spout tube can cause damage to the spray head, for example, leading to leaks or lack of performance from the spray head. The impact on the spray head is generally located in a vulnerable location of the spray head, where a water hose attaches to the spray head. Any damage to this connection point can lead to a leak and/or water damage beneath the sink. Accordingly, in many cases, the weight applied to the hose must be selected such that it is not unduly difficult for a user to pull out the spray head and hose for use, and so that the impact of the spray head on the spout tube caused by the retracting force of the weight does not cause damage. Furthermore, the impact of the collision between the spray head and the spout tube not only provides the potential for damage, it is aesthetically unpleasing to experience for a user. Accordingly, some users will deliberately, manually re-seat the spray head into contact with the spout tube to avoid such collisions. This adds a level of implicit potential inconvenience to the user.

SUMMARY

In general terms, this disclosure is related to a faucet having a retractable spray head with a slow close feature.

In a first aspect, a faucet includes a faucet base, a faucet spout, and a spray head movable between a retracted position and an extended position. A hose extends through the faucet spout and connects a water source to a spray head. A magnet is connected to the hose. A ring collar is fixed at least partially within the faucet spout and is formed of a non-ferretic and non-magnetic conductive material. The hose and the magnet are movable relative to the ring collar, and the magnet is positioned at least partially within the ring collar when the spray head is located in the retracted position.

In another aspect, a faucet spray head assembly is described. The faucet spray head assembly includes a magnet, a ring collar, and a ring collar mount. The magnet is connected to a hose extending from a spray head to a water source connection through a faucet spout. The ring collar includes a non-ferretic and non-magnetic material. The ring collar mount is configured to affix the ring collar within the faucet spout. The magnet and the ring collar cause a soft-close retraction effect as a faucet spray head is retracted toward the faucet spout.

In yet another aspect, a faucet includes a faucet base, a pull-out spray head, a faucet spout, a hose, a hose weight, a magnet, and a ring collar. The faucet base is adapted to be mounted on a sink deck. The faucet spout has an interior passage, a first end connected to the faucet base, and a second end capable of receiving the spray head. The hose extends through the interior passage of the faucet spout. The hose has a first end connected to a water source, a middle portion extending through the faucet base, and a second end connected to the spray head. A hose weight is located near the first end of the hose and under the faucet base. The magnet is connected to the middle portion of the hose. The ring collar is fixed within the first end of the faucet spout. The hose and the magnet are configured to be movable within the ring collar, and the magnet resides at least partially within the ring collar when the spray head is located adjacent the second end of the faucet spout.

In yet another embodiment, a faucet spray head assembly is described. The faucet includes a non-ferretic, non-magnetic material connected to a hose extending from a spray head to a water source connection through a faucet spout, a ring collar comprising a magnet, and a ring collar mount configured to affix the ring collar within the faucet spout. The non-ferretic and non-magnetic material and the ring collar cause a soft-close retraction effect as a faucet spray head is retracted toward the faucet spout.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
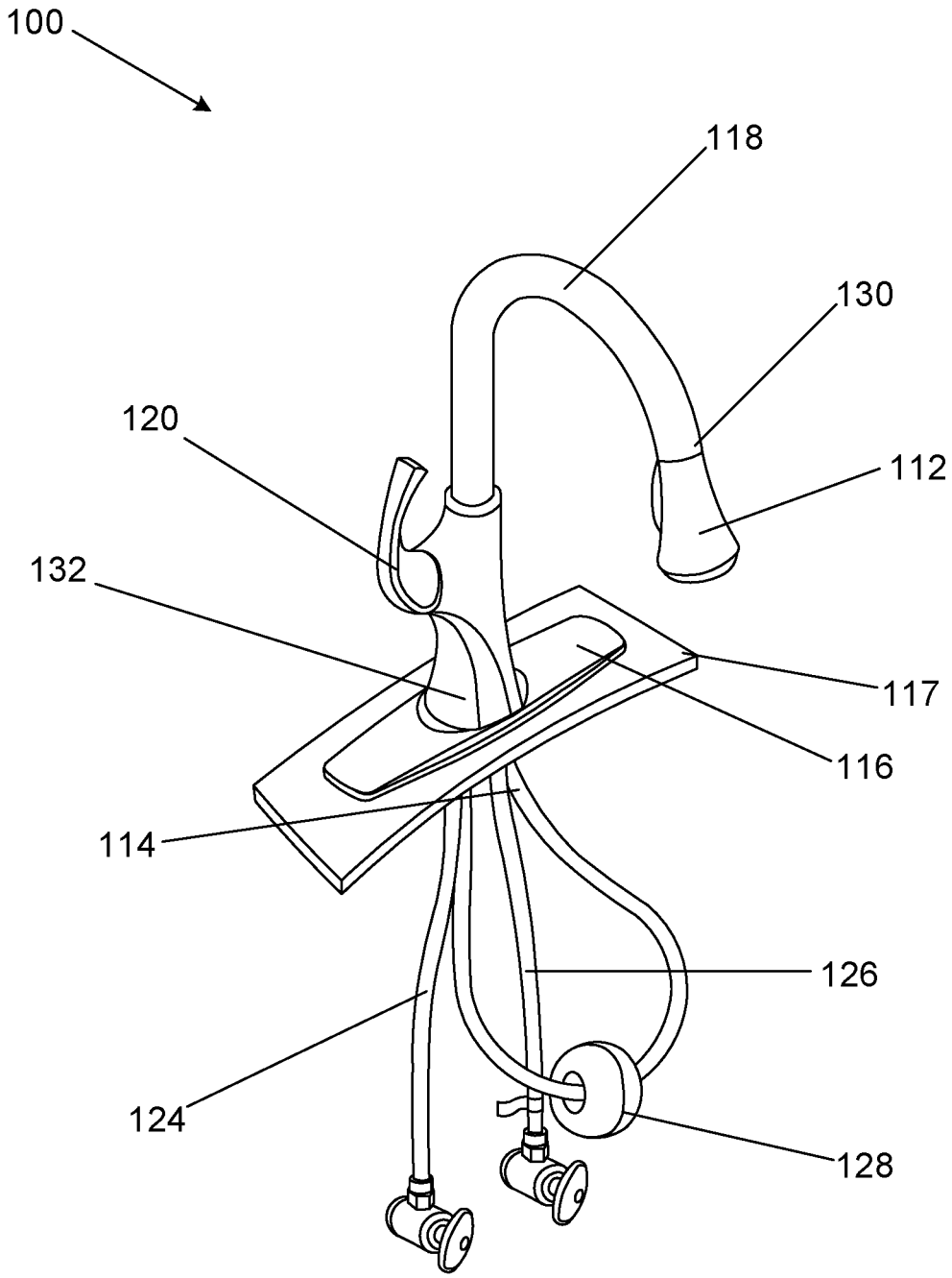
FIG. 1 illustrates a perspective view of a faucet with a retractable spray head in accordance with the present disclosure.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

In general, the present disclosure is directed to a pull-down or pull-out faucet having a "soft close" feature, e.g., dampening the recoil effect caused by a weight on a hose and spray head that has been pulled away from a faucet spout. In particular embodiments, a magnetic effect caused by a magnet passing through a conductive, non-ferretic and non-magnetic material cylinder can be used to slow retraction of the faucet spout and/or hose. The interaction by the magnet and cylinder may occur anywhere along the length of the hose between the weight and the spray head. In some cases, and as illustrated herein, the cylinder may be mounted at least partially within the faucet spout, with the magnet being movable in association with the hose. As the hose approaches a docked position (e.g., when released by a user from a pull-out position), the magnetic effect may slow the retraction of the spray head, thereby gently returning it to its original seated (retracted) position.

FIG. 1 illustrates a representative faucet 100 in which a soft-close feature can be implemented. FIG. 1 specifically shows a perspective view of a faucet 100 including a faucet spray head 112 configured in accordance with the present invention. The faucet 100 may be mounted, for example, to a kitchen sink or to other sink structures, such as for example, a utility sink or a bathroom tub.

In the example shown, faucet 100 includes a base 116, a faucet spout 118, and a water controller 120. In alternative examples, multiple water controllers 120 may be used, wherein a first controller controls hot water and a second controller controls cold water. Hot and cold water conduits 124, 126, respectively, such as for example, copper pipes or plastic tubing, connect the faucet 100 to a water source (not shown). The faucet spout 118 is connected at a first end 132 to the base 116 and at a second end 130 to the faucet spray head 112. A hose 114 supplies a flow of water, including hot and/or cold water, in proportions as selected by the water controller 120.

Hot and cold water conduits 124, 126 lead to a cartridge (not shown, typically within a handle and/or base 116), with water flow controlled by the water controller 120. The cartridge is fluidically connected to the hose 114 that extends through the faucet spout 118 to the faucet spray head 112. As such, the hose 114 is connected at one end, indirectly, to a water source (via conduits 124, 126) and at an opposite end to the spray head 112.

In the embodiment shown, the faucet 100 is mounted to a countertop 117 (a portion of which is shown). The base 116 is mounted above the countertop 117, and hot and cold water conduits 124, 126 lead through the base 116 to the cartridge, with the hose 114 extending back down through the countertop 117 and up through the faucet spout 118 to the faucet spray head 112. A hose weight 128 is placed around the hose 114, below the countertop 117. The hose weight 128 is located below the base 116 and slides along the hose 114. The hose weight 128 provides a pulling force on the hose 114 to cause the spray head 112 to retract into the faucet spout 118 utilizing gravity.

The faucet 100 includes the faucet spray head 112 that is detachable from the second end 130 of the faucet spout 118. As shown, the spray head 112 is in a retracted position, where the spray head 112 is docked at the second end 130 of the faucet spout 118. In an extended position, the spray head 112 is movable away from the second end 130 of the faucet spout 118 so as to allow a user the ability to manipulate the spray head 112 during use. This is facilitated by the hose 114 having excess length attached to the spray head 112 and being extendable through the faucet spout 118, with additional slack hose being stored under the countertop 117.

The hose weight 128 is positionable around the hose 114 (as shown in FIG. 1) to urge the spray head 112 to the retracted position. The hose weight 128 slides along the hose 114 as the spray head 112 is pulled away from the second end 130 of the faucet spout 118. The hose weight 128 has a weight that is greater than the weight of the spray head 112, which allows the hose weight 128 to pull the spray head 112 back into the retracted position.

In use, a user pulls the faucet spray head 112 away from the faucet spout 118, moving the faucet spray head 112 from the retracted position to the extended position. When the user releases the spray head 112, the hose weight 128 causes the spray head 112 to retract back toward the retracted position at the second end 130 of the faucet spout 118.

In example embodiments, the spray head 112 may be fitted with one or more alignment features, such that, when a user releases the spray head 112 from an extended position and it retracts toward the second end 130 of the faucet spout 118, the spray head 112 returns to a predetermined alignment. Details regarding an example alignment feature usable in a pull-out faucet are provided in U.S. Patent Publication No. 2020/0063408, which is hereby incorporated by reference in its entirety.

The faucet 100 can, in the various embodiments described herein, include a soft-close feature. This feature, as described in more detail below, is usable in a pull-down or pull-out faucet, and decreases the speed at which the spray head is retracted back to the faucet spout for at least a portion of the distance that the spray head retracts to the faucet spout. The soft-close feature comprises, in some embodiments, a magnet and a ring collar made from a non-ferretic metal material. Generally, the magnet is affixed to the hose, at a fixed distance away from the spray head. As the spray head is released and moves toward the retracted position, the magnet moves toward the ring collar, along an axial direction of the ring collar. As the magnet begins passing through the ring collar, an electromagnetic field effect occurs in accordance with the Lenz effect. The electromagnetic field effect causes the speed that the magnet moves toward or through the ring collar to decrease, which causes the speed of the spray head to decrease as it is retracted back to the faucet spout.

In example embodiments, the magnet and ring collar are placed in positions relative to each other, so in a retracted position of the faucet spout, the magnet resides at least partially within the ring collar.

The soft-close feature may be implemented on a variety of faucets, including but not limited to, kitchen faucets and tub faucets. Further, the faucet 100 is configured to be controlled (i.e., on/off, water volume, and water temperature) via traditional methods (e.g., a handle as seen in FIG. 1), and/or via gesture or voice.

Although this disclosure will be discussed with regard to a kitchen faucet for purposes of example, the system described herein could be implemented in any type of pull-down faucet and/or a pull-out faucet, including a side auxiliary spray faucet. In some examples, the faucet is a showerhead in a shower or a pull-out faucet for a tub in a bathroom. In some examples, the faucet is any fluid dispensing device that is configured to dispense fluid therefrom.

Figure 2:
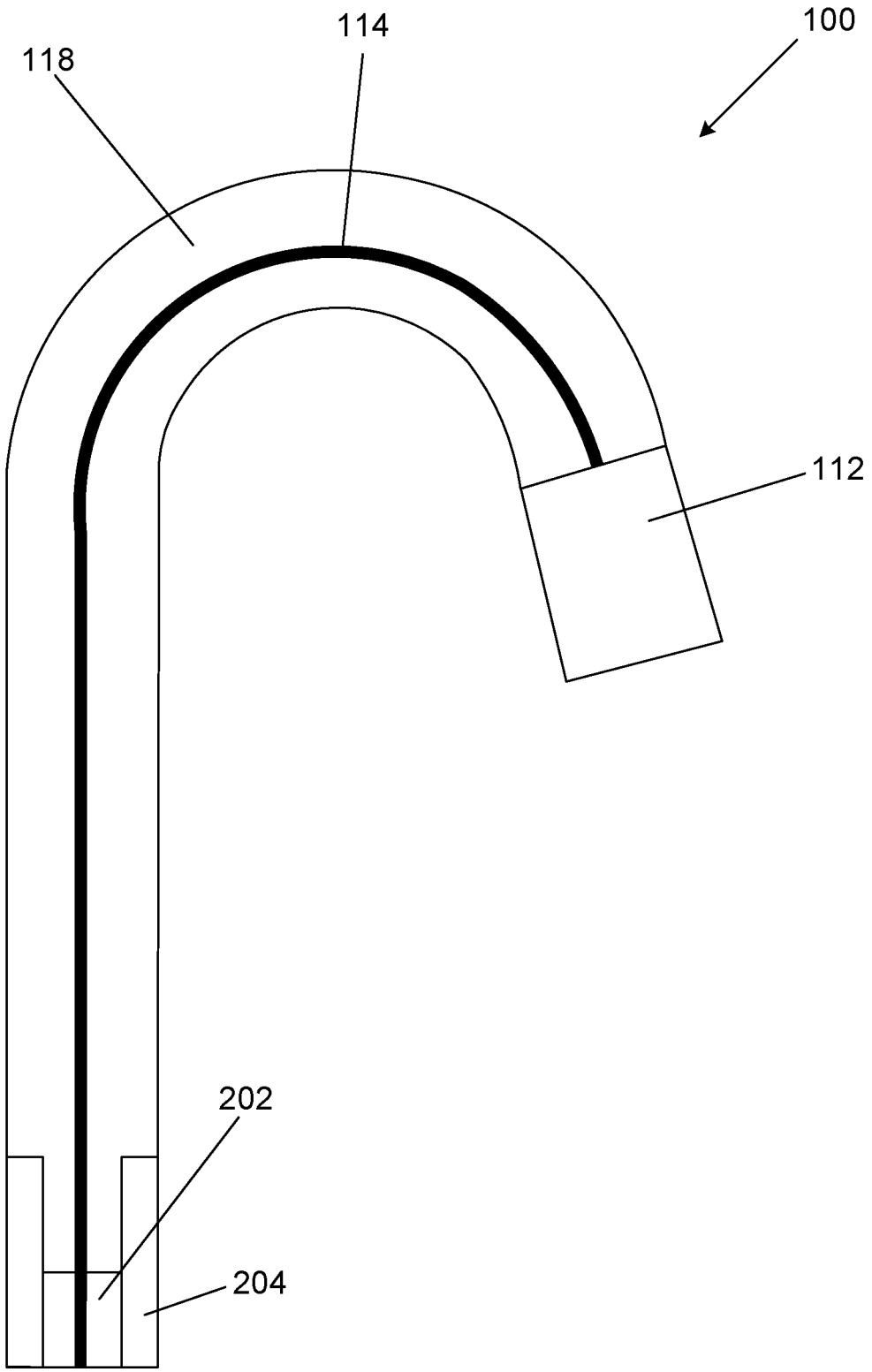
FIG. 2 illustrates a cross-sectional view of the faucet spout and spray head of FIG. 1 in a retracted position.

FIG. 2 illustrates a schematic vertical cross-sectional view of portions of the faucet 100. In this schematic view, faucet 100 is shown in a retracted position, where the spray head 112 is located adjacent to the faucet spout 118. The hose 114 extends through the interior of the faucet spout 118, having a first end extending through the base (not shown) to a water source (not shown) and a second end connected to the spray head 112.

In the embodiment shown, a ring collar 204 is located at an end of the faucet spout 118 located near the base (not shown). The ring collar 204 is fixedly attached to the faucet spout 118, so it is stationary and does not move, even as the hose 114 and an attached magnet 202 move relative to it. As described above, the ring collar 204 may be attached directly to the faucet spout 118, or may be connected via a ring collar mount (not shown).

The ring collar 204 comprises a non-ferretic and non-magnetic conductive material. For example, the ring collar 204 may be made from a material selected from gold, brass, copper, zinc, and aluminum. Other similar materials may be used.

In some embodiments, the magnet 202 is spaced apart from the spray head 112 a distance such that the magnet 202 remains at least partially within the faucet spout 118 in both the retracted and extended positions. The magnet 202 is attached to the hose 114 at a location so as to place the magnet 202 at least partially within the ring collar 204 when the spray head 112 is in a retracted position. For example, the magnet 202 may be located entirely within the ring collar 204 or the magnet 202 may extend at least partially below the bottom edge of the ring collar 204 when the spray head is in the retracted position. In some embodiments, the magnet 202 may have passed entirely through the ring collar 204 by the time the spray head 112 reaches the retracted position.

In the embodiments described herein, the ring collar 204 is ring shaped and has a hole through which the hose 114 and the magnet 202 are capable of extending. In an alternative embodiment, the ring collar 204 is connected to the hose 114 and the magnet 202 is fixed to the faucet spout 118. In an embodiment where the ring collar 204 is attached to the hose 114, the ring collar 204 may be a billet, such as a copper billet. In an embodiment with a ring collar billet, the hose 114 is separated into two pieces, connected by the billet. A first hose extends through the faucet spout 118 to the spray head 112 and a second hose extends to the water source.

Figure 3:
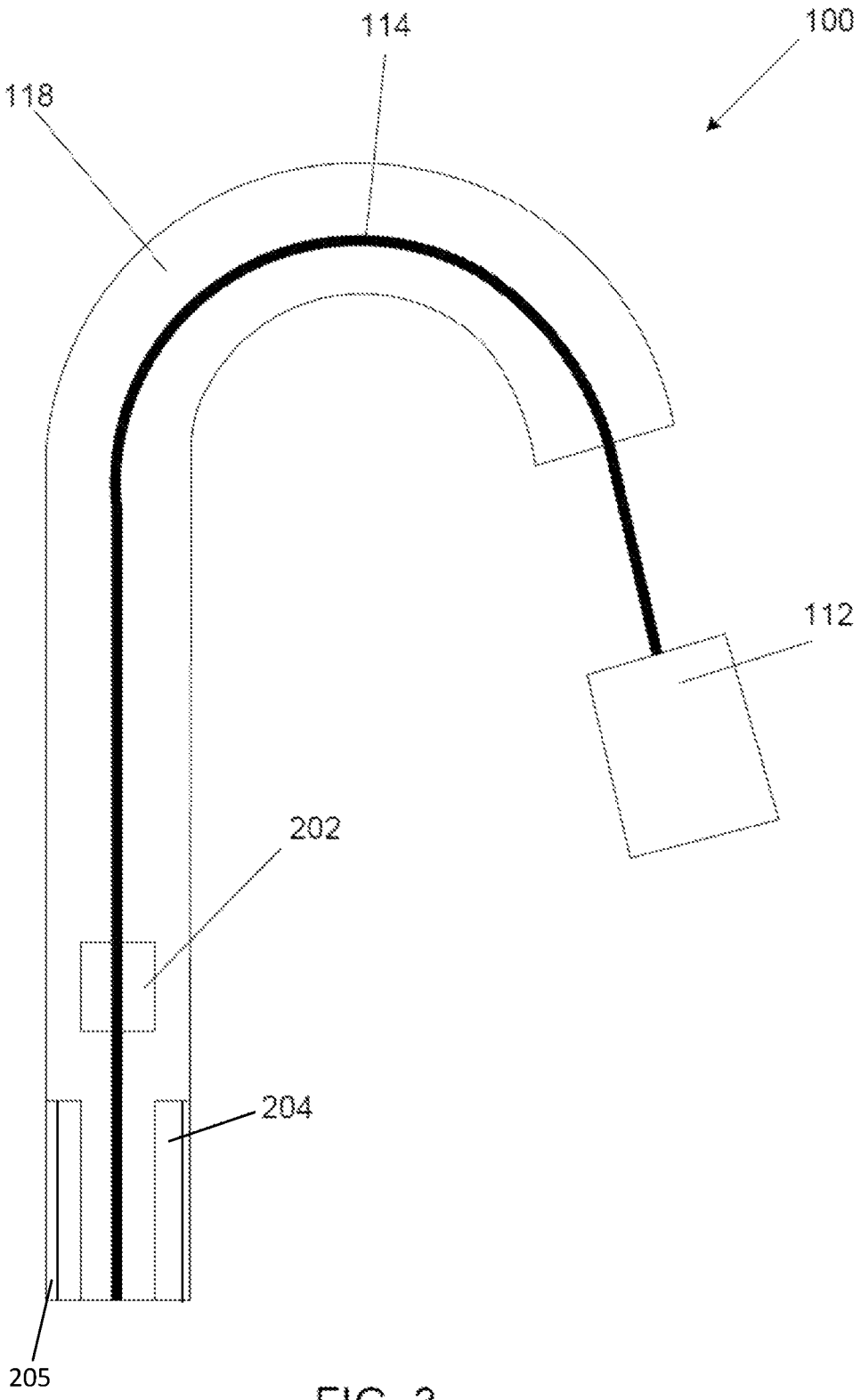
FIG. 3 illustrates a cross-sectional view of the faucet spout and spray head of FIG. 1 in an extended position.

In an alternative embodiment, the ring collar 204 is connected to the faucet spout 118 via a ring collar mount 305 (shown in FIG. 3). A ring collar mount 205 allows the ring collar 204 to be mounted in any desired faucet 100. A ring collar mount 205 may be shaped similar to the ring collar 204 and connects the ring collar 204 to the faucet spout 118. The ring collar mount 205 may be made from low-cost materials, such as plastics.

Although not shown, in an alternative embodiment, a magnet and ring collar may be located in opposing positions in the faucet 100 and will still produce the same soft-close pull-out spray head effect. In such an embodiment, the ring collar will be sized to fit within a cylindrical magnet, and moves with the hose toward the magnet, along an axial direction of the magnet. The hose and collar subsequently begin passing through the magnet, which creates the electromagnetic field and resulting soft-close effect.

FIG. 3 illustrates a schematic vertical cross-sectional view of the faucet 100, with the spray head 112 in an extended position. As shown, the spray head 112 is located away from the faucet spout 118. When the spray head 112 is pulled away from the faucet spout 118, the hose 114 and the connected magnet 202 are also moved away from the ring collar 204. When the magnet 202 is located a sufficient distance away from the ring collar 204, or the magnet 202 is not moving near the ring collar 204, there is no electromagnetic field induced that would be sufficient to create the soft-close effect discussed herein. Rather, such an effect will happen as the magnet 202 and ring collar 204 begin to be concentrically aligned (e.g., with the magnet beginning to pass through the ring collar).

Figure 4:
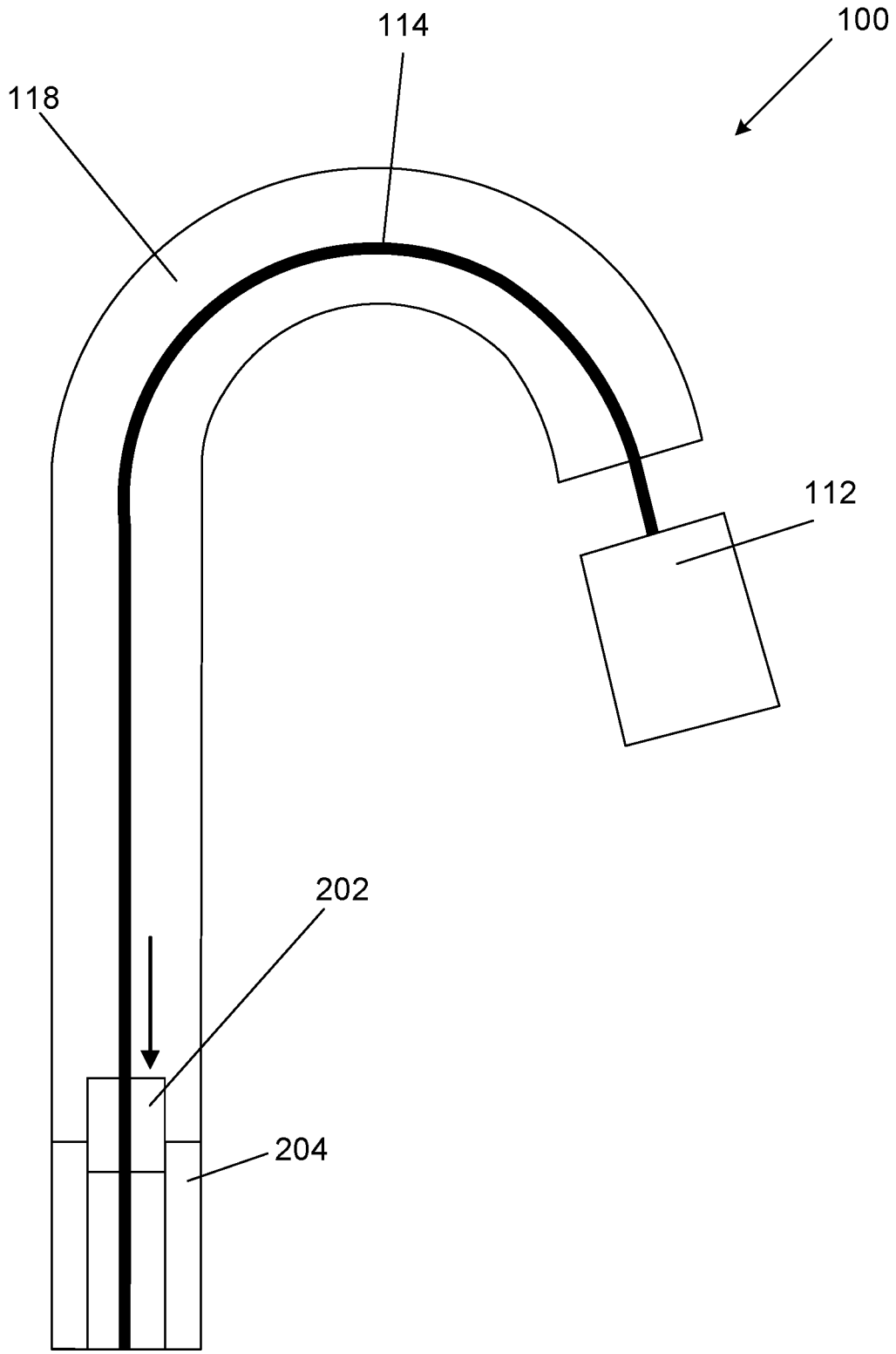
FIG. 4 illustrates a cross-sectional view of the faucet spout and spray head of FIG. 1 while retracting.

FIG. 4 illustrates a schematic vertical cross-sectional view of the faucet 100 in a retracting motion (e.g., moving from the position seen in FIG. 3 toward the position seen in FIG. 2). As shown, the spray head 112 moves towards the faucet spout 118, for example, after a user releases the spray head 112. The hose weight (not shown) causes the spray head 112 (and hose 114) to retract back to the faucet spout 118. As the hose 114 retracts, the magnet 202 moves toward the ring collar 204, which induces an electro-magnetic current in the ring collar 204, and causes the speed of the magnet 202 as it approaches the ring collar 204 to decrease. The decrease in the speed of the moving magnet 202 and the attached hose 114 produces a soft-close effect of the spray head 112.

Figure 5:
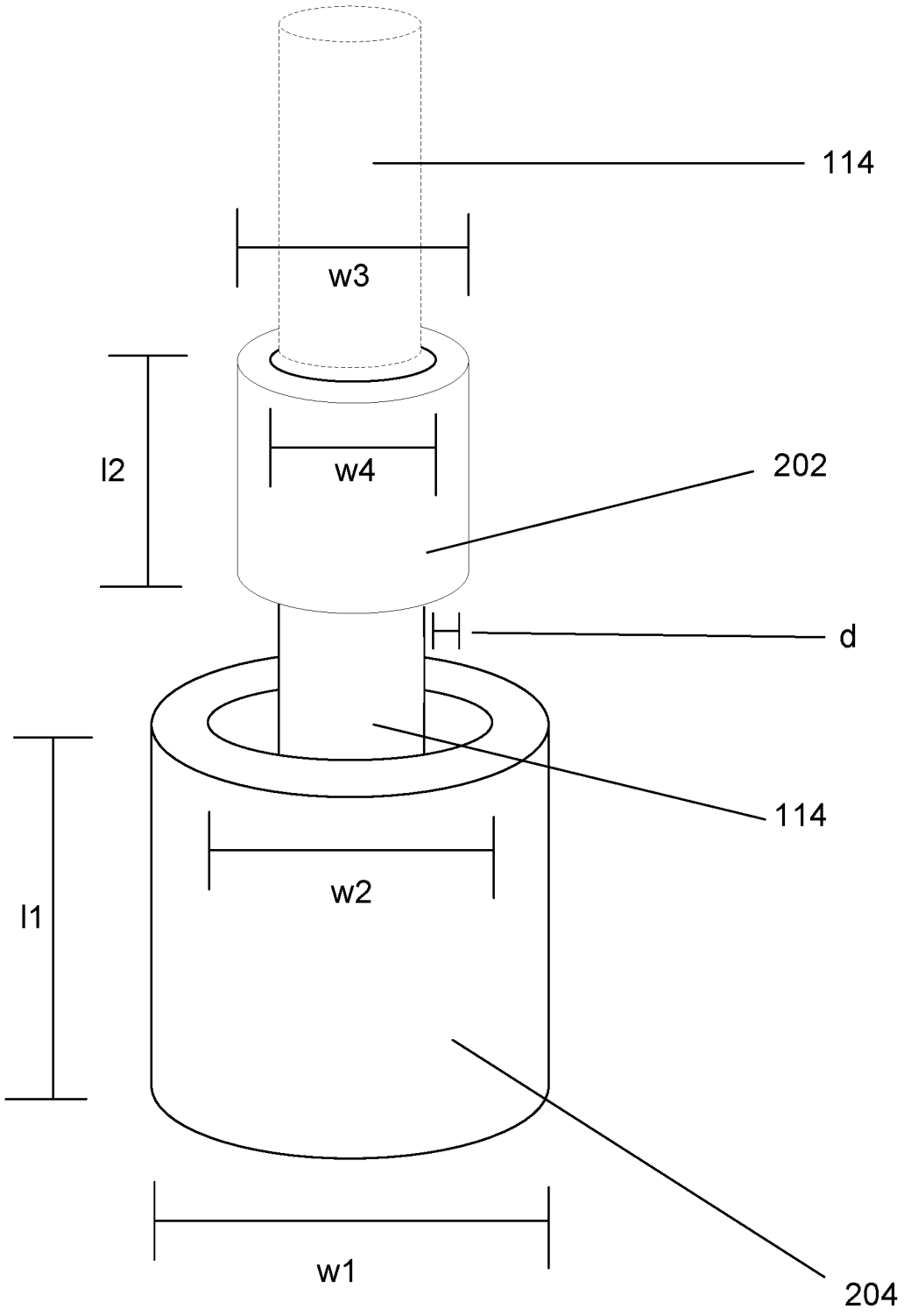
FIG. 5 illustrates an exploded view of a magnet and a ring collar of the faucet.

FIG. 5 shows a detailed view of how the magnet 202, hose 114, and ring collar 204 interact, in an example embodiment. As described in more detail below, the magnet 202 and the ring collar 204 utilize the Lenz effect to produce a soft-close effect as the spray head 112 is retracted toward the faucet spout 118. As the moving magnet 202 approaches the stationary ring collar 204, the moving magnet 202 generates an electromagnetic field that otherwise is not present. The generated electromagnetic field in the ring collar 204 opposes the magnetic field of the falling magnet 202. The result causes the descent of the magnet 202 to slow, which creates a soft-close effect of the spray head 112.

The ring collar 204 has an outer diameter w1 and an inner diameter w2. The outer diameter w1 has a size to fit within a standard faucet spout 118. For example, the outer diameter w1 is less than about 4.0 inches, for example, about 2.5 to about 3.0 inches. In an embodiment utilizing a ring collar mount (not shown), the ring collar mount may have an outer diameter to fit within a standard faucet spout 118, and the outer diameter w1 of the ring collar 204 is less than the ring collar mount, for example, having an outer diameter w1 of about 2.5 to about 3.0 inches.

The inner diameter w2 of the ring collar 204 has a size to allow the hose 114 and magnet 202 to fit within the ring collar 204. For example, the inner diameter w2 may be less than about 2.5 inches. The ring collar 204 may have a length l1 of less than about 10 inches. Alternatively, the ring collar 204 may be from about 1.5 inches long to about 3.0 inches long. The length l1 of the ring collar 204 is at least or greater than the length l2 of the magnet 202.

The ring collar 204 may be connected to the faucet spout 118 or the ring collar mount mechanically, such as with a clamp, or with epoxy or glue. In an embodiment with a ring collar mount, the ring collar mount may be connected to the faucet spout 118 mechanically, such as with a clamp, or with epoxy or glue.

The magnet 202 is located around the hose 114 at a point where the magnet 202 is located at least partially within the ring collar 204 when the spray head 112 is in the retracted position. The magnet 202 may be attached to the hose 114 with epoxy, glue, or other similar mechanism. The magnet 202 also has a ring shape with an outer diameter w3 and an inner diameter w4. The outer diameter w3 may be about 2.5 inches, or from about 2 inches to about 3.0 inches. The inner diameter w4 is great enough to fit around a standard faucet hose 114. For example, the inner diameter w4 may be about ½ inch, or about ⅜ inch. The magnet 202 may have a length l2 of about 2 inches. Alternatively, the magnet 202 may be from about 1.5 inches long to about 3 inches long.

The clearance distance (or air gap) d between the magnet 202 and the ring collar 204 is as small as possible. For example, the clearance distance d between the magnet 202 and the ring collar 204 may be less than ¼ inch, for example about 1/16 inch, or about ⅛ inch. This is shown in more detail at FIG. 6.

Figure 6:
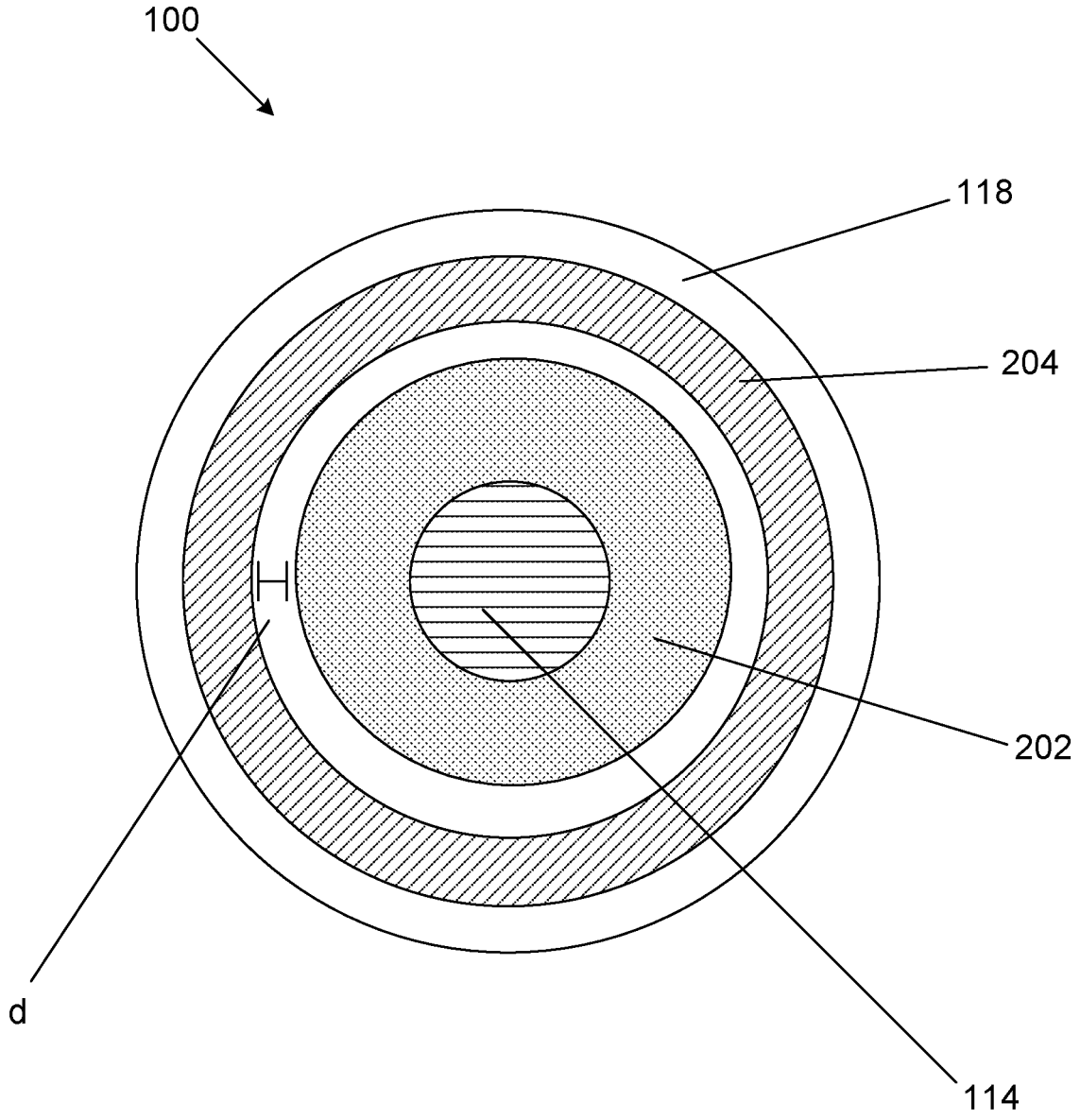
FIG. 6 illustrates a horizontal cross-sectional view of the faucet spout, a hose, the magnet, and the ring collar.

FIG. 6 shows a horizontal cross-sectional view of the faucet 100. The faucet spout 118 is the outermost structure of the faucet 100. The ring collar 204 is located adjacent the faucet spout 118. Although not shown, a ring collar mount may be positioned between the faucet spout 118 and the ring collar 204.

The magnet 202 surrounds the hose 114 and the hose 114 is the innermost structure. The magnet 202 is fixedly attached to the hose 114. Surrounding the magnet 202 is the ring collar 204, and surrounding the ring collar 204 is the faucet spout 118. As shown, the magnet 202 and the ring collar 204 have a ring shape. However, other shapes of a magnet 202 and a ring collar 204, such as a semi-ring, will still induce the Lenz effect.

Referring to FIGS. 1-6 generally, it is noted that various other arrangements of the magnet 202 and collar 204 are possible as well. For example, although discussed above as being mounted within the faucet spout 118, the ring collar 204 may be mounted at any of a variety of locations along a path of the hose 114 that would allow the hose to move between the extended position and the retracted position. For example, in some embodiments, the ring collar 204 may be mounted at least partially below the base 116, e.g., below a countertop level.

The slow-close feature described herein provides advantages such as preventing damage to a faucet when a user releases the spray head. The slow-close feature reduces the speed at which the spray head retracts when the spray head nears the faucet spout. Therefore, damage, such as water leaks is prevented. Further, having a slow-close feature located within the faucet and/or below the deck provides an aesthetically pleasing design.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

The invention claimed is:

1. A faucet comprising:

a faucet base;

a faucet spout having an interior passage, a first end connected to the faucet base, and a second end;

a spray head movable between a retracted position in which the spray head is proximate to the second end of the faucet spout and an extended position positioned away from the second end;

a hose extending through the interior passage of the faucet spout, the hose having a first end connected to a water source and a second end connected to the spray head, the hose extending through the faucet spout;

a magnet affixed to the hose; and a ring collar fixed at least partially within the faucet spout, the ring collar comprising a non-ferretic and non-magnetic conductive material, wherein the hose and the magnet are movable relative to the ring collar as the spray head is moved between the retracted position and the extended position, wherein the magnet is positioned at least partially within the ring collar when the spray head is located in the retracted position, and wherein the ring collar is positioned proximate to the faucet base and the magnet is affixed to the hose such that the magnet is slidable with the hose within the interior passage as the spray head is moved between the retracted position and the extended position.

2. The faucet of claim 1, wherein the magnet and the ring collar are located at least partially below the faucet base when the spray head is in the retracted position.

3. The faucet of claim 1, wherein the magnet and the ring collar are located above the faucet base when the spray head is in the retracted position.

4. The faucet of claim 1, wherein, in the extended position, the magnet is positioned within the interior passage.

5. The faucet of claim 1, wherein the ring collar is made from a material selected from gold, brass, copper, zinc, and aluminum.

6. The faucet of claim 1, further comprising a hose weight positioned along the hose between the water source and the faucet base.

7. The faucet of claim 6, wherein the hose weight has a weight greater than a weight of the spray head.

8. The faucet of claim 1, wherein an electromagnetic effect of the magnet on the ring collar reduces a retraction speed of the spray head as the spray head moves toward the retracted position from the extended position.

9. The faucet of claim 1, wherein when the magnet is located at least partially within the ring collar, a distance between the magnet and the ring collar is less than ¼ inch.

10. The faucet of claim 9, wherein the distance between the magnet and the ring collar is less than ⅛ inch.

11. The faucet of claim 1, wherein the ring collar is affixed within the faucet spout by a ring collar mount.

12. The faucet of claim 1, wherein the ring collar has an inner diameter of less than about 2.5 inches, an outer diameter of less than about 4 inches, and a length of less than about 10 inches.

13. The faucet of claim 1, wherein the magnet has an outer diameter of less than about 4 inches and a length of less than about 10 inches.

14. The faucet of claim 1, wherein the ring collar has a length greater than a length of the magnet.

15. A faucet spray head assembly comprising:

a magnet connected to a hose extending from a spray head to a water source connection through a faucet spout;

a ring collar comprising a non-ferretic and non-magnetic material; and a ring collar mount configured to affix the ring collar within the faucet spout;

wherein the magnet and the ring collar cause a soft-close retraction effect as a faucet spray head is retracted toward the faucet spout.

16. The faucet spray head assembly of claim 15, wherein the magnet and the hose are movable within the ring collar.

17. The faucet spray head assembly of claim 16, wherein the magnet resides at least partially within the ring collar when the faucet spray head is in a retracted position.

18. A faucet comprising:

a faucet base adapted to be mounted on a sink deck;

a pull-out spray head;

a faucet spout having an interior passage, a first end connected to the faucet base, and a second end capable of receiving the spray head;

a hose extending through the interior passage of the faucet spout, the hose having a first end connected to a water source, a middle portion extending through the faucet base, and a second end connected to the spray head;

a hose weight located near the first end of the hose and under the faucet base;

a magnet connected to the hose and disposed between the first end of the hose and the second end of the hose; and a ring collar fixed within the first end of the faucet spout, wherein the hose and the magnet are configured to be movable within the ring collar, and wherein the magnet resides at least partially within the ring collar when the spray head is located adjacent the second end of the faucet spout.

19. The faucet of claim 18, wherein, as the spray head moves toward the second end of the faucet spout based at least in part on an effect of the hose weight on the hose, the magnet and the ring collar cause a retraction of the spray head to reduce in speed.

20. A faucet spray head assembly comprising:

a non-ferretic, non-magnetic material connected to a hose extending from a spray head to a water source connection through a faucet spout;

a ring collar comprising a magnet; and a ring collar mount configured to affix the ring collar within the faucet spout;

wherein the non-ferretic and non-magnetic material and the ring collar cause a soft-close retraction effect as a faucet spray head is retracted toward the faucet spout.

21. The faucet spray head assembly of claim 20, wherein the non-ferretic, non-magnetic material and the hose are movable within the ring collar.

22. The faucet spray head assembly of claim 21, wherein the non-ferretic, non-magnetic resides at least partially within the ring collar when the faucet spray head is in a retracted position.

* * * * *